United States Patent [19]

Scheipner

[11] Patent Number: 4,674,395

[45] Date of Patent: Jun. 23, 1987

[54] SIMPLIFIED REMOTE SIGHTING OF ARTILLERY GUN

[75] Inventor: Robert H. Scheipner, Velbert, Fed. Rep. of Germany

[73] Assignee: Rheinmetall GmbH, Duesseldorf, Fed. Rep. of Germany

[21] Appl. No.: 658,541

[22] Filed: Oct. 9, 1984

[30] Foreign Application Priority Data

Oct. 6, 1983 [DE] Fed. Rep. of Germany ..... 3336399

[51] Int. Cl.[4] ..... F41G 3/16

[52] U.S. Cl. ..... 89/41.19

[58] Field of Search ..... 89/41.19, 41.21, 41.22, 89/41.14; 235/409, 406; 33/239; 235/406

[56] References Cited

U.S. PATENT DOCUMENTS

| | | | |
|---|---|---|---|
| 1,930,481 | 10/1933 | Kruger | 235/409 |
| 2,428,372 | 10/1947 | Knowles et al. | 235/409 |
| 4,409,468 | 10/1983 | Mayer et al. | 89/41.01 |

FOREIGN PATENT DOCUMENTS

| | | | |
|---|---|---|---|
| 0975157 | 9/1975 | Canada | 89/41.19 |
| 1269543 | 5/1968 | Fed. Rep. of Germany | 89/41.19 |

*Primary Examiner*—Stephen C. Bentley
*Assistant Examiner*—Stephen M. Johnson

[57] ABSTRACT

An artillery piece having a gun which is aligned on a target from a director remote from the artillery piece by first measuring, at the director, the angle formed between a line through the director with the target and a line from the director through the artillery piece, and communicating this director angle to the artillery piece. Then at the artillery piece, the angle is measured that is formed between the gun barrel and a line from the piece through the director. These two angles are added together and the gun is pivoted through an angle equal to the sum thus derived. The director angle is sighted backward away from the target. In addition the piece has a periscope and the director angle is sighted to the periscope and the tank angle is sighted from the periscope, which is an offset from the upright gun-pivot axis.

3 Claims, 4 Drawing Figures

10
24
N
20
24
23
21'
23'
b
22
23'

10
P
23
20
21'
22
21

SIMPLIFIED REMOTE SIGHTING OF ARTILLERY GUN

FIELD OF THE INVENTION

The present invention relates to the sighting of a gun from a remote director. More particularly this invention concerns an artillery or tank gun.

BACKGROUND OF THE INVENTION

The standard method of aiming an artillery piece such as a tank gun from a director remote from the gun entails measuring the director angle whose apex is at the director and whose one side is defined by a base line 3200− offset from the sight line extending from the director to the target and whose other side is defined by a line extending from the director to the tank, as both the target and the gun are visible from the director. This tank angle is then radioed to the tank whose turret is pivoted until the angle formed between the tank barrel and a line from the tank to the director is equal to the director angle. This turning is controlled by a scale in the tank that is set to zero at the director angle.

Such a system will produce a perfect aiming of the tank barrel parallel to the sight line if the director and tank angles are both determined from the center of rotation of the tank turret from which the barrel axis extends. Normally, however, both sightings are taken at the tank periscope which, because of space constraints, is mounted somewhat offset from the turret axis so that as a result the barrel position is slightly off. An initial angular error of 10− (0.5625°) is common, whereas accurate shooting requires an angular error of at most 1−. This maladjustment is corrected by iterating the sighting procedure, taking two new readings from the director and one from the gun and repivoting the tank turret in accordance with the new readings. For very accurate shooting this iteration procedure must be done several times.

OBJECTS OF THE INVENTION

It is therefore an object of the present invention to provide an improved method of sighting in an artillery piece.

Another object is the provision of such a method of sighting in an artillery piece which overcomes the above-given disadvantages, that is which eliminates the initial error that necessitates the above-described reiteration.

SUMMARY OF THE INVENTION

A method of sighting an artillery piece having a gun in on a target from a director remote from the artillery piece according to this invention comprises the steps of first, as is usual, measuring at the director the angle formed between a line aligned through the director with the target and a line from the director through the artillery piece and communicating this director angle to the artillery piece. Then according to the invention at the artillery piece the angle is measured that is formed between the gun barrel and a line from the piece through the director. These two angles are added together and the gun is pivoted through an angle equal to the sum thus derived.

With this method, therefore, the gun is pivoted in one step into the position perfectly parallel to the base line. Since both bearings are taken before the gun turret moves, any error created by taking them with respect to a location that moves between measurements is eliminated. The system is convenient also in that it works perfectly well in those arrangements where the measurements are indeed taken from the pivot axis, so a gun crew will not have to learn new procedures when equipment changes.

According to this invention the director angle is sighted backward away from the target. In addition the piece has a periscope and the director angle is sighted to the periscope and the tank angle is sighted from the periscope, which as mentioned above is offset from the upright gun-pivot axis.

The hardware according to this invention can be a simple calculator in the tank along with the standard transit-type range and elevation equipment. In fact the instant invention can be carried out with the equipment normally available for navigation in a tank.

DESCRIPTION OF THE DRAWING

The above and other features and advantages will become more readily apparent from the following, reference being made to the accompanying drawing in which.

SPECIFIC DESCRIPTION

Figures 1, 1A, 1B:
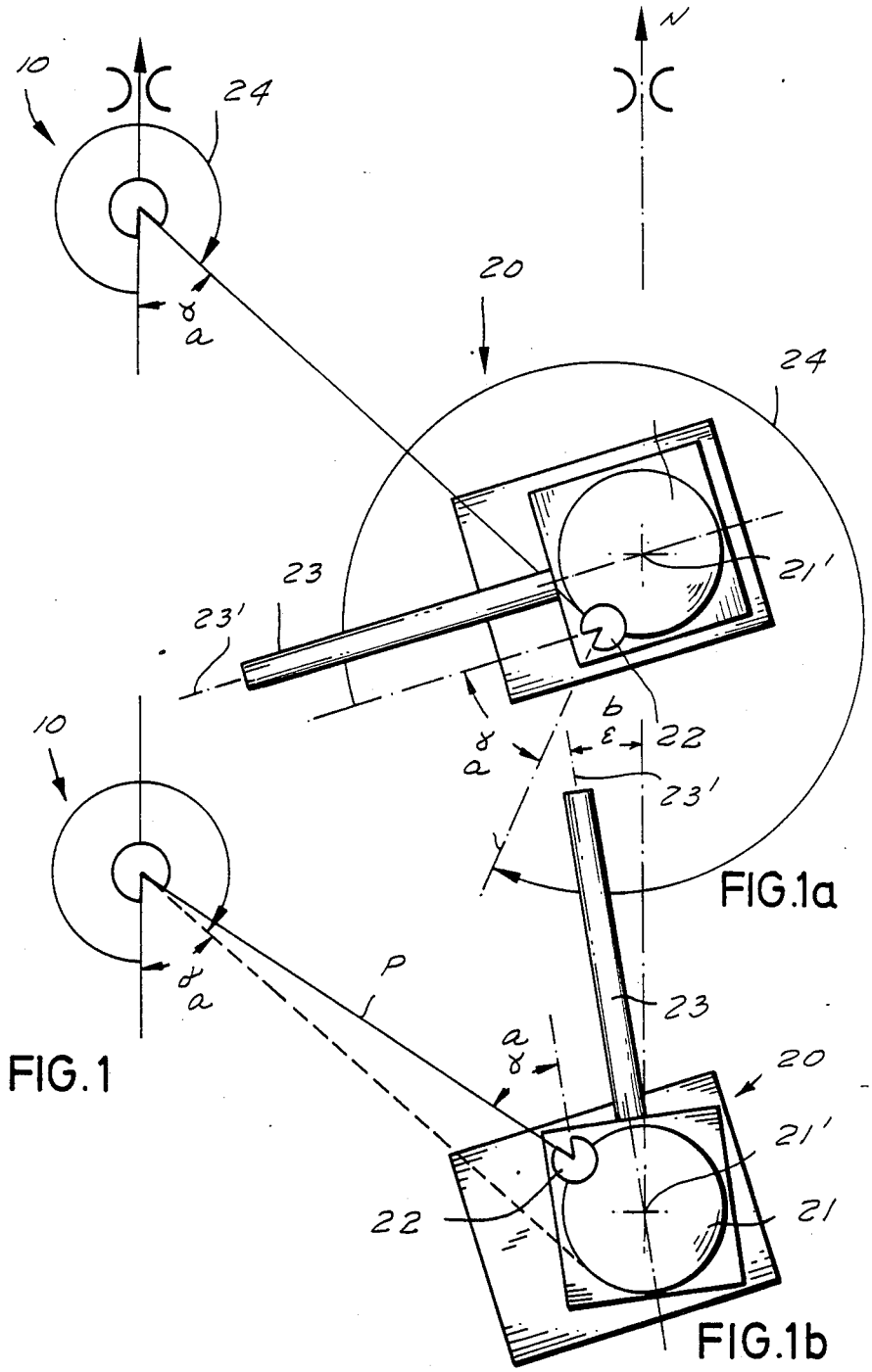
FIGS. 1*a* and 1*b* are top views illustrating the prior-art aiming procedures.

As seen in FIGS. 1*a* and 1*b* a transit-type director 10 works together with an artillery piece 20, here a tank, to be aimed. The tank 20 has a turret 21 pivotal as is standard about a vertical axis 21' and carrying a barrel or firing tube 23 and a panoramic periscope 22. The barrel 23 is centered on an axis 23' lying in the same vertical plane as the axis 21', but the periscope 22 is offset from these axes 21' and 23'.

In the prior-art system illustrated in FIGS. 1*a* and 1*b* the director 10 is aimed along a base line 10' that is shown to be exactly 6400− north for purposes of illustration. The tank 20 is ready to fire but is not aimed, that is it does not know the base-line direction. The director 10 will take the bearing to the periscope 22 to determine the director angle 24, which here is equal to 5500−.

This director angle 24 is normally radioed from the director 10 to the firing officer in the tank 20. This angle 24 is then set on the scale of the panoramic periscope 22 relative to the null position. Finally the turret 21 is pivoted until the line of sight or spider line P is sighted in on the director 10, that is until the barrel axis 23' defines the angle a with the sight line P between the tank 20 and director 10. Due to the equivalence of the alternate angles a, this positioning ensures that the barrel line 23' is parallel to the base line 10' only in situations where the scope 22 is at the axis 21'. In the standard illustrated arrangement where the scope 22 is offset from this axis 21', the line 23' extends at an angle b to the line 10', and the procedure is to resight the scope 22 from the director 10 and readjust everything, reducing the error with each such aiming cycle.

Figures 2, 2A, 2B:
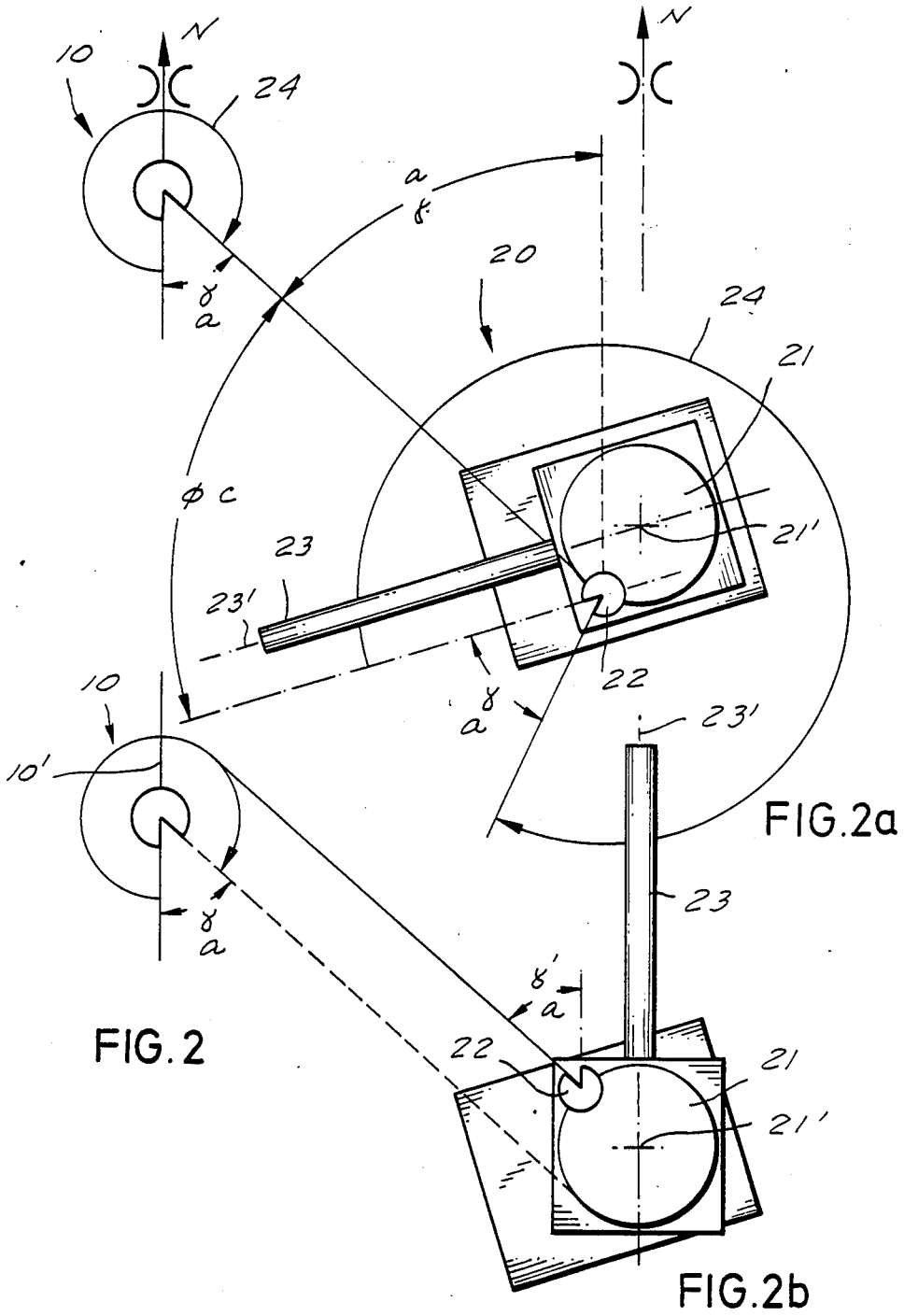
FIGS. 2*a* and 2*b* are top views illustrating the aiming method of the present invention.

According to the instant invention this problem is avoided by the method shown in FIGS. 2*a* and 2*b*, where the same reference numerals and letters are used for identical things.

FIG. 2*a* shows the gun 20 loaded but not yet aimed, with the director 10 once again aimed with its base line 10' on north 6400−. The director 10 sights in the periscope 22 of the piece 10 to determine the director angle 24 and this is radioed to the firing officer in the piece 20. Unlike the method described above, however, the turret 21 is not swung about its axis 21', but instead the firing officer in the tank 20 sights in the director 10 and determines the angle c between the tube axis 23' and the director 10 without changing the turret position at all. The angle a determined at the director 10 and the angle c determined in the tank 20 are then added to establish a pivot angle through which the turret 21 is rotated.

This procedure therefore completely eliminates the error caused by the eccentricity of the scope 22 relative to the axis 21'. It eliminates the error created by taking two measurements between points one of which moves between measurements. In addition it requires no extra time or equipment on behalf of the director or gun crew, and represents a considerable increase in accuracy with less adjustment.

What is claimed is:

1. A method of aligning an artillery piece, with a gun, on a target from a director, remote from the artillery piece, comprisisng the steps of:

measuring, at the director, the angle formed between a line through the director with the target, and a line from the director through an artillery piece;

communicating the director angle to the artillery piece;

measuring, at the artillery piece, the angle formed between the gun barrel and a line from the artillery piece through the director;

adding the two angles together; and then pivoting the gun through an angle equal to the sums of the director angle plus the artillery piece angle.

2. The artillery alligning method described in claim 1 wherein the director angle is measured at ā point away from the target.

3. The artillery aligning method defined in claim 2 wherein the artillery piece has a periscope, and the director angle is measured to the periscope, and the artillery piece angle is measured from the periscope.

* * * * *